United States Patent [19]

Goldfarb et al.

[11] 4,356,657

[45] Nov. 2, 1982

[54] TOY CAR WASH APPARATUS AND METHOD

[75] Inventors: Adolph E. Goldfarb, 4614 Monarca Dr., Tarzana, Calif. 91356; Delmar K. Everitt, Woodland Hills, Calif.

[73] Assignee: Adolph E. Goldfarb, Tarzana, Calif.

[21] Appl. No.: 233,675

[22] Filed: Feb. 11, 1981

[51] Int. Cl.[3] ..... A63H 33/00

[52] U.S. Cl. ..... 46/12; 46/202

[58] Field of Search ..... 46/12, 39, 40, 202, 46/201, 91

[56] References Cited

U.S. PATENT DOCUMENTS 2,776,522 1/1957 Schramm et al. ..... 46/12 X 3,751,847 8/1973 Neuhierl ..... 46/202 X

FOREIGN PATENT DOCUMENTS 1074461 1/1960 Fed. Rep. of Germany ..... 46/12

1166303 1/1960 France ..... 46/39

*Primary Examiner*—Paul J. Hirsch

*Assistant Examiner*—Mickey Yu

*Attorney, Agent, or Firm*—Romney, Golant, Martin, Disner & Ashen

[57] ABSTRACT

A toy car wash for advancing a toy car along a car washing line, applying water to the car, brushing the car, and then rapidly spinning the wet car to remove water. The water is essentially confined within the toy by use of a transparent top cover, a water capturing bottom cover or pan, and effective water removal before the toy car exits the device. The spinning mechanism includes a rotatable cradle that receives the car, and retains it without physical attachment and without further action by the user while it is being spun dry. The device provides a series of separate player-controlled operations which affords continuous user involvement and a high level of play value.

31 Claims, 13 Drawing Figures

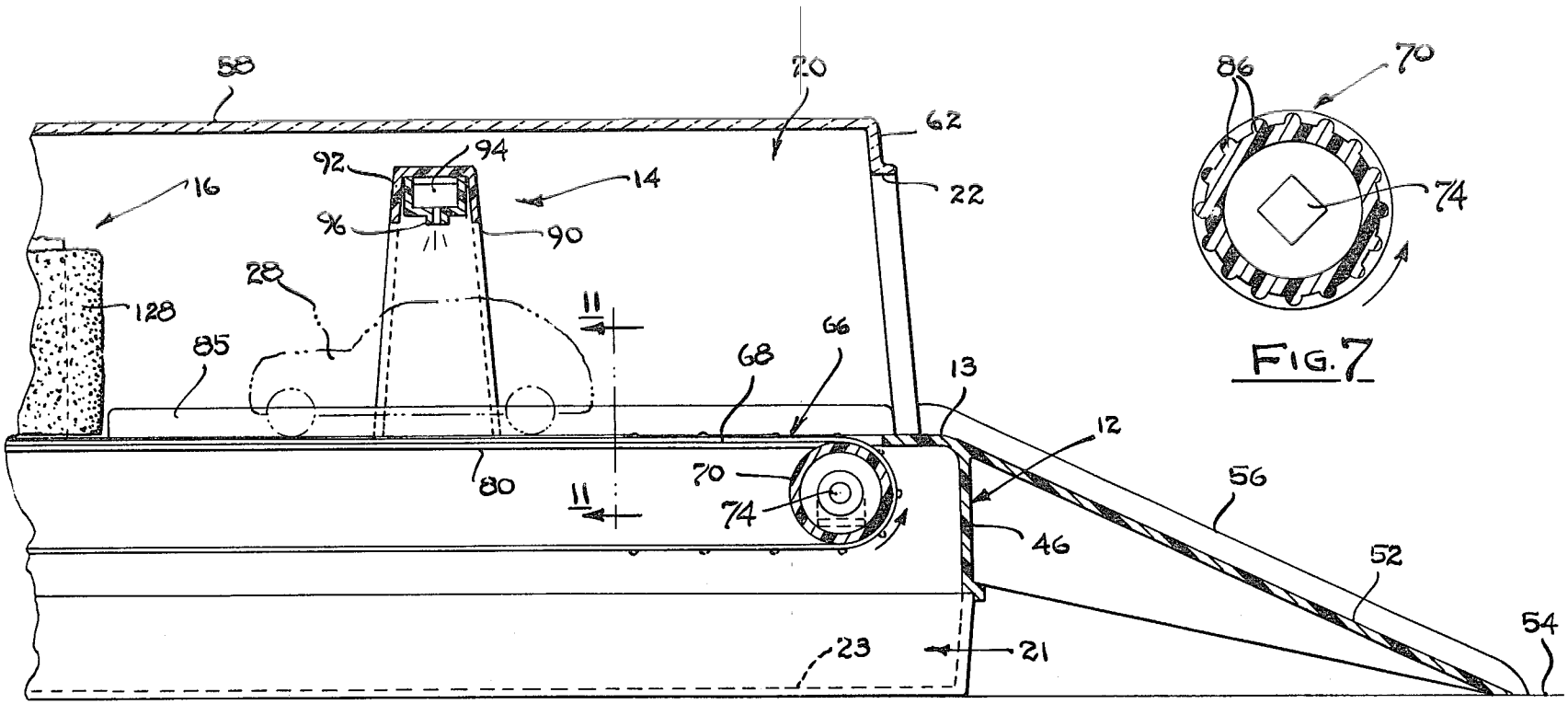
FIG. 3
FIG. 7
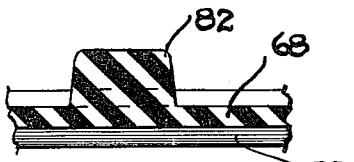
FIG. 9
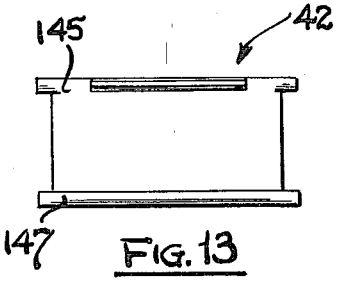
FIG. 13
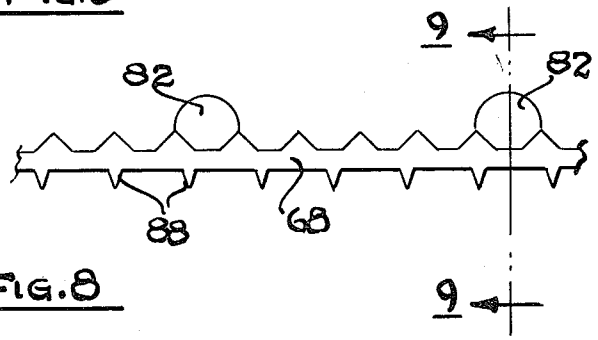
FIG. 8

TOY CAR WASH APPARATUS AND METHOD

FIELD OF THE INVENTION

Activity toys for use with toy vehicles, and more particularly such a toy simulating features of a real life car wash.

BACKGROUND

Toys simulating real life situations relating to vehicles have always been popular with children. Thus, there are toy or play garages, airports, bus stations, etc., which simulate various feature of real life relating to each situation. Such play apparatus provides varying degrees of realism; with the greater the realism, the greater the play value. A car wash is a real life situation that a child would usually have had some exposure to, however, there is a natural reluctance by parents (and thus toy manufacturers) to provide toys which utilize water (aside from bathtub or beach type toys) because of the risks of the child getting the water on the floor, the furniture, etc. Further, such play apparatus often is automatically or semi-automatically controlled and/or powered, so that the child user is an observer with minimum involvement in the operation of the device. He or she simply starts the apparatus in operation, and watches it go through its cycle.

SUMMARY OF DISCLOSURE

The illustrated device provides a car wash toy which utilizes water in its play in such a way as to tend to contain the water and thus minimize the risk of water damage to the surroundings. More particularly, the car wash line is essentially enclosed and viewable through a transparent top cover; water that is applied to the car is retained by a bottom cover or pan; then the wet car is rapidly spun dry to remove water.

The illustrated device is manually or hand powered by a series of mechanical means: a hand crank to operate a conveyor belt to advance the car, a reciprocating plunger pump to apply water to the car, a reciprocating handle to spin dry the car, and a hand openable exit gate to permit a gravity induced discharge of the car from the device. Such mechanically powered arrangements are much less costly to manufacture and to maintain then electrical powered means using electric motors, and the like. The mechanism for spin drying the car is operable to receive the car and retain it while it is spun dry; when spinning is completed, the mechanism is operable to position the car for discharge from the car wash. In this connection, a rotatable platform forms a cradle with an inclined support surface that is aligned to receive the car from the conveyor. The car is retained on the platform as it rapidly rotates, solely by virtue of the cradle configuration and without a physical connection between the car and the platform and without the child having to do anything further to secure the car in place. The cradle exit is then aligned with the car wash exit for discharge of the car. Further, the child has the opportunity to sequentially and separately operate each of the mechanisms at his or her own speed, to provide a high degree of involvement and play value.

IN THE DRAWINGS

FIG. 3 is an enlarged sectional view taken generally along line 3—3 of FIG. 1, showing in detail the entrance end of the device;

FIG. 7 is an enlarged sectional view of the drive wheel of the conveyor means for the illustrated device;

FIG. 8 is a further enlarged view of a section of the conveyor belt for the device;

FIG. 9 is a transverse section taken generally along line 9—9 of FIG. 8 showing further details of construction of the conveyor belt;

FIG. 13 is a view taken from the front of the exit gate of the spinning platform.

Figure 1:
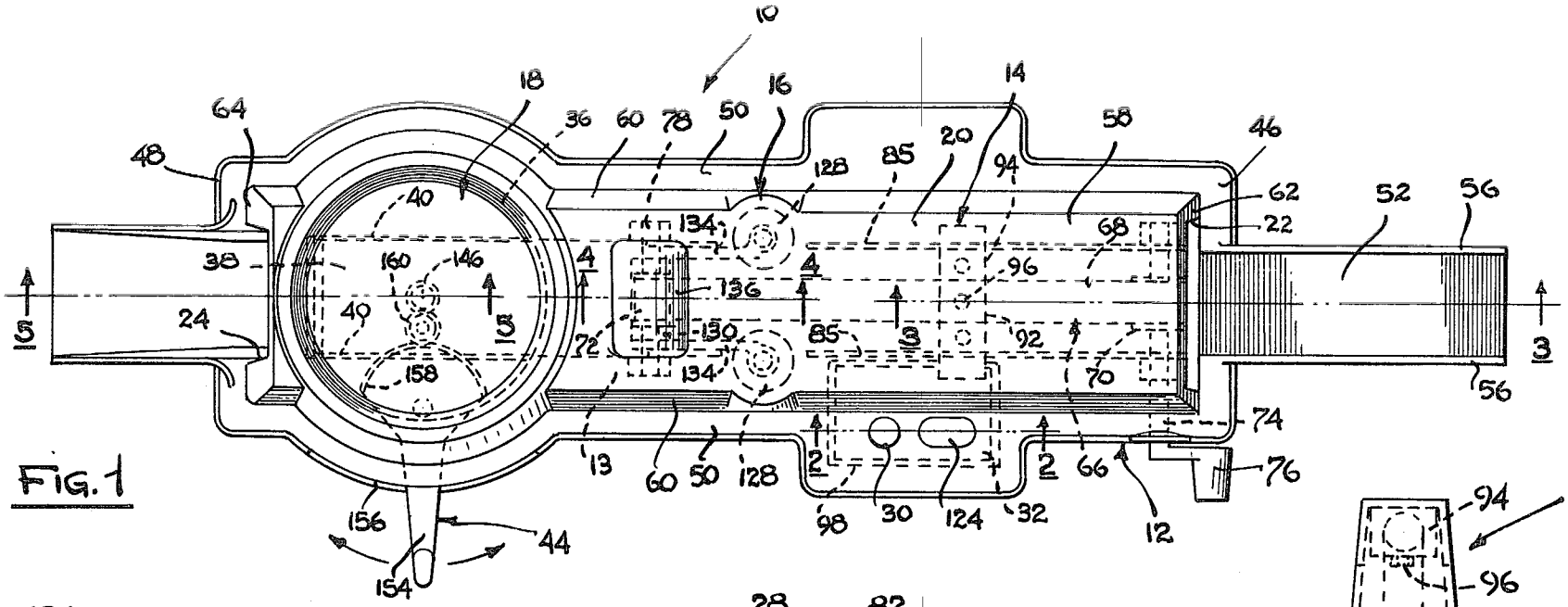
FIG. 1 is a plan view of a toy car wash comprising a presently preferred embodimernt of the invention.

Briefly, the illustrated toy car wash 10 comprises an elongated frame 12 which has a top wall 13 that supports a car wash line having a series of stations; a spray or wetting station 14, a brushing station 16, and a spin drying station 18. The line and the stations are essentially enclosed by a transparent top cover 20. A bottom cover or tray 21 is also provided for enclosing various operating mechanisms and a water reservoir and for receiving and holding water. The frame 12 and cover 20 form an entrance 22 at one end and an exit 24 at the other end. The frame supports a handcrank powered conveyor means 66 which is operable to advance a toy car 28 from the entrance 22 successively to the spray station 14, the brushing station 16 and the spin drying station 18. At the spray station 14 a manually operated pump mechanism 30 circulates water from a reservoir 32 to an overhead water discharge manifold 94. At the spin drying station 18, a rotatable platform 36 in the form of a cradle with an inclined upper surface 38, a pair of side curbs 40 and an exit gate 42 is operable to receive the car and retain it while the platform is rotated by a manually operated drive mechanism 44. The platform is then positioned to discharge the car from the exit 24.

More particularly, the elongated frame 12 may be constructed of any suitable material and is illustrated as a single molded plastic part. The illustrated frame 12 has generally an elongated rectangular box-like configuration, being open at the bottom and having the upper or top wall 13, an end wall 46 at the entrance end, an end wall 48 at the exit end, and a pair of elongated opposed side walls 50. As shown best in FIGS. 1 and 3, the frame 12 also includes an upwardly inclined entry ramp 52 which extends from the surface 54 supporting the frame to the frame upper wall 13. The entry ramp 52 includes upright curbs 56 along either side edge. The ramp 52 is proportioned for the toy car 28 to be moved from the supporting surface up along the ramp to the entrance 22 to the car wash line. The transparent cover 20 is conveniently formed of a clear molded plastic in an elongated, generally rectangular box-like configuration, with a top wall 58, a pair of elongated side walls 60, an entry end wall 62 and an exit end wall 64. The cover 20 is mounted atop the frame 12 so as to essentially enclose the car wash line. The entry end wall 62 of the cover is formed to provide the entrance 22 to the start of the car wash line. The exit end wall 64 of the cover is similarly formed to provide the exit 24 at the end of the car wash line. As noted above, the spray station 14, the brushing station 16 and the spin drying station 18 are spaced longitudinally along the car wash line, and are generally disposed on the top wall 13 of the frame and enclosed by the cover 20. Their operations are of course visible to the user through the transparent cover 20. The bottom cover or pan 21, which may also be a molded plastic part, is connected to the underside of the frame 12. The pan will accumulate water which can be emptied out through an opening (not shown) in a side or end wall spaced above pan bottom wall 23.

Figure 11:
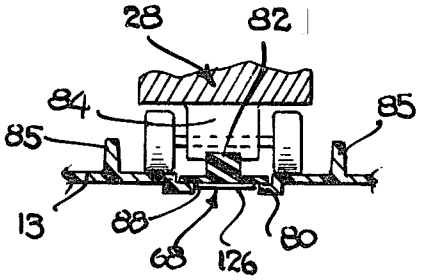
FIG. 11 is a transverse sectional view taken generally along line 11—11 of FIG. 3, showing details of the conveyor or advancing means.
Figures 5, 6, 10, 12:
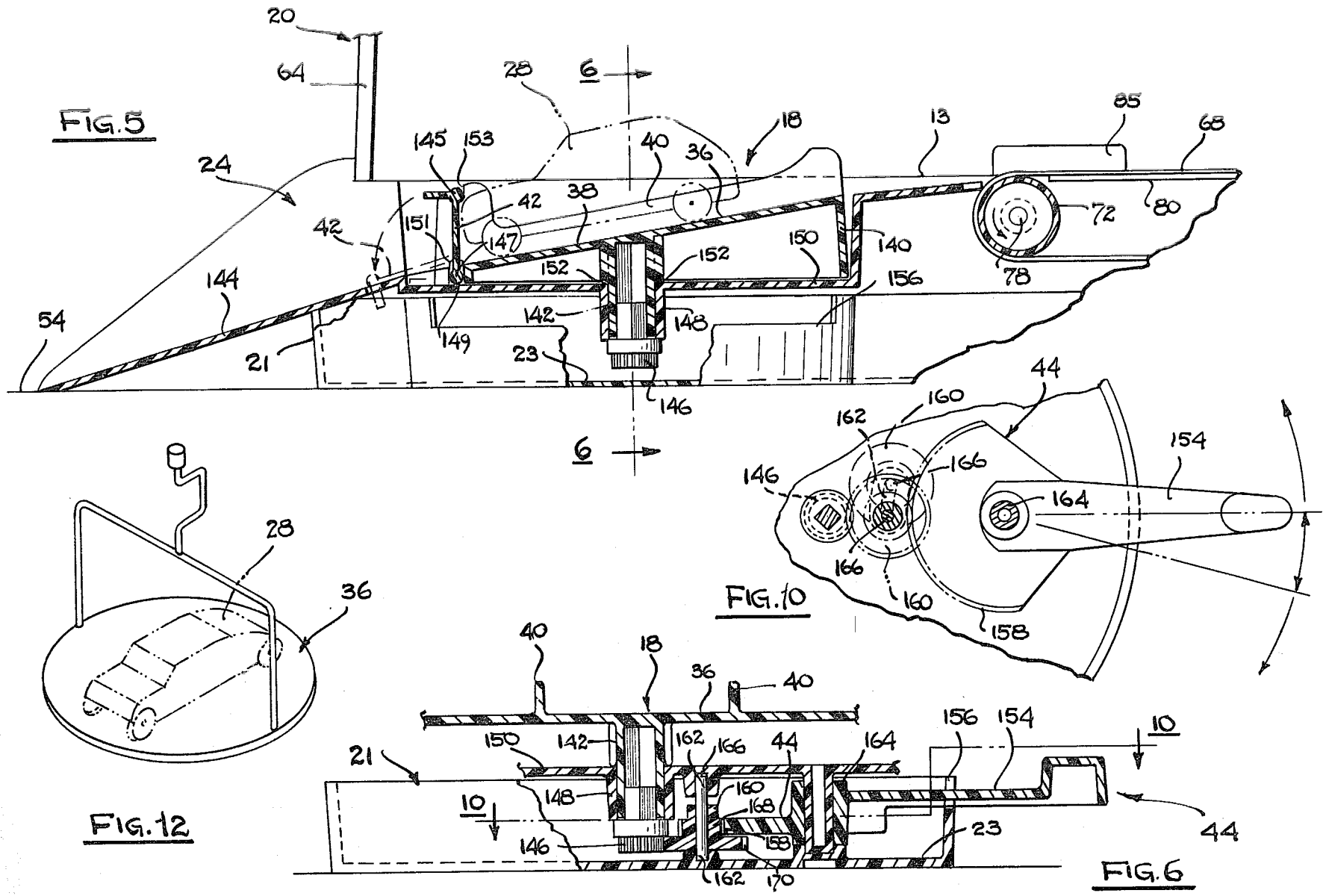
FIG. 5 is an enlarged sectional view taken generally along line 5—5 of FIG. 1, illustrating the exit end portion of the device.
FIG. 6 is a sectional view taken generally along line 6—6 of FIG. 5, further illustrating the spin drying station of the device.
FIG. 10 is a cross sectional view taken generally along line 10—10 of FIG. 6, illustrating the driving means for the spinning station of the device.
FIG. 12 is a schematic showing of an alternate form of drive means for the platform.

A conveyor means 66 is provided, starting at about the entrance 22 to the car wash line (see FIG. 3) and terminating after the spray station and the brushing station and a short distance before the spin drying station (see FIG. 5). The illustrated conveyor means 66 comprises an endless conveyor belt 68 supported between a drive roller 70 and an idler roller 72. The rollers 70, 72 are rotatable about generally horizontal and transversely extending axes located so as to position the top run of the belt generally parallel and aligned with the top wall 13 of the frame. The drive roller 70 is located as shown in FIG. 3 just past the entrance 22, and is fixedly secured to a shaft 74 rotatably journaled, by any suitable means, on the frame. The shaft 74 extends outwardly to one side of the frame as shown in FIG. 1 and is provided with a manually turnable handle 76. The idler roller 72 may be rotatably mounted on a shaft 78 that is fixedly secured to the frame in a location, as illustrated in FIG. 5, a short distance before the spin drying station. As shown in FIG. 11, a longitudinal strip 80 that extends down the center of the top wall 13 is downwardly offset to receive and support the top run of the belt 68. Means on the belt 68 engages complimentary means on the toy car 28 to advance the car along the car wash line as the handle 76 is turned by the child. FIGS. 8 and 9 illustrate in detail the configuration of the conveyor belt 68. The illustrated belt 68 is provided at spaced apart locations along its outer surface with upstanding tabs or projections 82 which provide the complimentary engaging means of the belt. The conventional miniature car, with four freely rotating wheels, which the illustrated car wash 10 is designed to accommodate, has a transversely extending downward projection 84 at its front and rear underside. When such a car is manually advanced onto the conveyor belt 68, the belt tabs 82 will engage the projections 84 on the car, as shown in FIG. 11, to thereby move the toy car along with the conveyor belt. Upright side curbs 85 are provided on the top wall 13 to either side of the belt 68 to maintain the car in the desired path along the car wash line.

As shown in FIG. 7, the drive roller 70 is provided at spaced intervals around its periphery with a series of transverse extending ribs or projections 86 which mesh or interengage with projections 88 on the inside of the conveyor belt (FIG. 8) to transmit rotary motion from the drive roller to the conveyor belt. The top wall 13 is cut out adjacent each roller 70, 72 to permit the belt 68 to pass between a roller and the wall strip 80 (FIG. 11).

Figure 2:
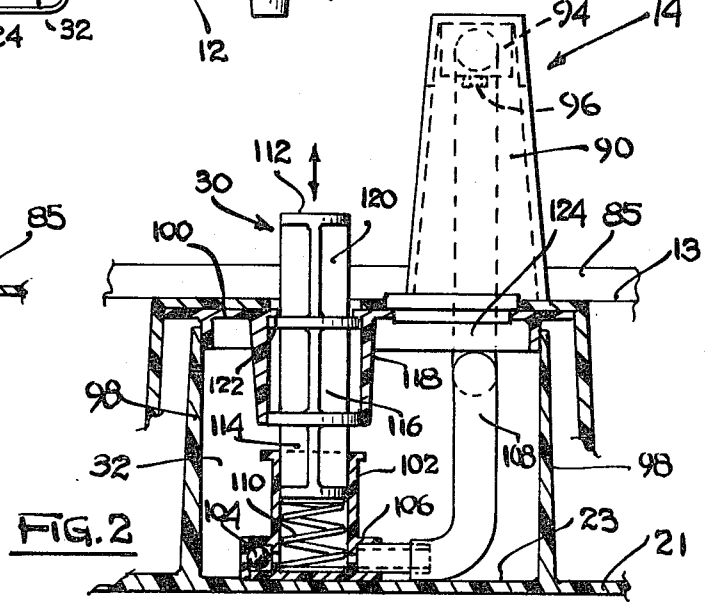
FIG. 2 is an enlarged sectional view taken generally along line 2—2 of FIG. 1, illustrating the wetting station of the device.

The illustrated spray station 14 comprises a generally inverted U-shaped stand having a pair of upright side leg portions 90 and an elevated transversely extending mid-portion 92. Within the mid-portion 92 there is a transversely extending spray or water discharging manifold 94 which is illustrated as having three transversely spaced apart downwardly directed discharge openings 96. The leg portions 90 straddle the conveyor belt 68 while the mid-portion 92 extends across the top, high enough to permit the toy car to pass below it. At the spray station, the frame 12 is widened to each side and the generally box-like reservoir 32 is provided below the top wall 13 and generally to one side of the spray stand as shown in FIGS. 1 and 2. As shown best in FIG. 2, the illustrated reservoir is formed by four upstanding side walls 98 mounted on the pan bottom wall 23. A top wall 100 is secured across the top of the reservoir. The pump mechanism 30 serves as noted above to pump water from the reservoir 32, up into the manifold 94 and out the discharge openings 96 onto the toy car positioned below them on the car wash line. More particularly, the reservoir 32 is formed with an upright low cylinder portion 102 secured to the bottom of the reservoir. At the lower end of the cylinder portion 102, which is immersed in water when the reservoir is filled, it is open to a one way ball-valve 104 and to an outlet 106 that connects to a tube or conduit 108 that extends up to and communicates with the discharge manifold 94. The ball-valve 104 operates to allow water from the reservoir to flow into the cylinder portion 102 while preventing water from flowing in the opposite direction back into the reservoir. A coil compression spring 110 is disposed in the bottom of the cylinder portion 102 and a vertically reciprocating plunger 112 has its lower end portion 114 extending into the cylindrical portion 102. The plunger 112 has an intermediate portion 116 which is received in sliding engagement and an upper cylindrical portion 118 secured to the top wall 100 of the reservoir. The plunger 112 also has an upper portion 120 which extends upwardly through the top wall 100 of the reservoir and the top wall 13 of the frame to be accessible to the child-user. As shown in FIG. 2, the plunger 112 is normally urged upwardly by the spring 110 to the position shown in that drawing, with the upper end of the intermediate portion 116 of the plunger engaging a lip 122 formed at the upper end of the upper cylindrical portion 118 to limit upward movement of the plunger. The plunger 112 may be depressed by the child-user by pushing down on its upper end against the force of the spring; this downward movement is limited by engagement of the lower end of the intermediate portion 116 of the plunger with the top edge of the lower cylindrical portion 102. The plunger 112 may be pumped up and down repeatedly by pushing it down against the spring and then releasing it to allow the spring to return it to the upper position and again depressing the plunger. This pumping action draws water from the reservoir through the one-way valve 104 into the lower cylindrical portion 102 and then pushes that water up through the conduit 108 to the discharge manifold 94 and out the discharge openings 96. The close sliding fit of the intermediate portion 116 of the plunger with the upper cylindrical portion 118 tends to prevent the water in the reservoir from leaving the toy through the openings for the plunger upper end. FIG. 1 shows an opening 124 in the top of the reservoir for filling it with water. As shown in FIG. 11 the offset center strip 80 has a center cut out 126 along its entire length to provide a pathway for water discharged at the wetting station to pass through the frame top wall 13 and fall into the bottom pan 21.

Figure 4:
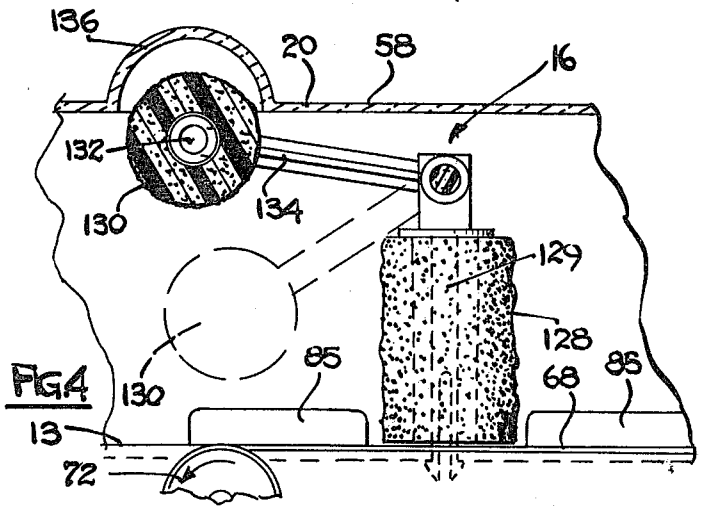
FIG. 4 is an enlarged sectional view taken generally along line 4—4 of FIG. 1, illustrating the brushing station of the device.

After the toy car has been watered down at the wetting station, the conveyor handle 76 may be turned to advance conveyor belt and the car to and through the brushing station 16. The illustrated brushing station 16 comprises a pair of spaced-apart generally cylindrical side brushes 128 supported on the frame top wall 13 for rotation about upright vertical shafts 129. The side brushes 128 extend about the height of the toy car as shown in FIG. 4, and as shown in FIG. 1 they are each positioned at one side of the conveyor belt 68 to engage the sides of the car as it passes the brushes. A third center brush 130 is also provided at the brushing station. The center brush 130 is disposed with its axis generally horizontal and transverse. The center brush 130 is rotatably mounted on a transversely extending shaft 132 supported at opposite ends by a pair of spaced-apart arms 134 that are in turn pivotally mounted at the upper ends of the upright shafts 129 supporting the side brushes 128. The center brush 130 is disposed generally centrally of the car wash line, directly above the conveyor belt 68, and will normally assume, by virtue of gravity, the lower dropped position illustrated in broken line in FIG. 4. As the car passes, being advanced by the positive drive of the conveyor belt, the front end of the car will engage and thus pivot the center brush upwardly; as the car continues forward, the center brush will ride over the top outline of the car. Thus, in a simple and economical way the illusion is created of the brush moving to follow the contour of the car as the car passes the brushing station. As shown in FIG. 4, the cover may include an outwardly bulbed portion 136 to accommodate the center brush in its elevated position as shown in solid line in FIG. 4.

As noted above, the upright curbs 85 at either side of the conveyor belt maintain the toy car moving generally along the car wash line. This insures that the car will pass between the two side brushes 128 and further insures its proper alignment when passing to the spin drying station.

The spin drying station 18 is illustrated particularly in FIGS. 1, 5, 6 and 10. In general, as noted above, the spin drying station comprises the rotatably mounted platform 36 forming a cradle for the toy car and hand powered control and drive means 44 for imparting rapid rotation to the platform. The platform 36 is positioned by the control and drive means to receive the car and to discharge it after the spinning is completed. Further, the platform retains the car during spinning without anything further required from the child-user. More particularly, the platform 36 is generally circular as viewed in plan, having the inclined top wall 38 and a downwardly extending peripheral side wall 140 (see FIG. 5). The platform also has a central downwardly extending shaft section 142. The two upwardly extending spaced-apart curbs 40 on the top wall 38 of the platform are in generally parallel relation to one another to define the car receiving area or cradle which is generally centered on the axis of rotation of the platform. As illustrated in FIG. 1, the curbs 40 on the platform have generally the same spacing as the curbs 85 on the frame to provide a continuation of the car wash line for the toy car. When the platform is rotated to the position illustrated in FIGS. 1 and 5, the curbs 40, 85 are aligned and the incline of the top wall 38 of the platform is downwardly toward the discharge end of the toy. As also shown in FIG. 5, at the lower end of the car retaining area or cradle the exit or discharge gate 42 is provided. The gate 42 may be releasably latched in the position shown in solid line (FIG. 5) to retain the car on the platform. Thus, the car will be received on the platform between the curbs 40, tending to roll down the inclined upper wall 38 of the platform but being restrained by the closed gage 42. The illustrated gate 42 may be lifted and then pivoted, as suggested by the arrow in FIG. 5, to the broken line position shown in that figure to permit the car to roll from the platform onto and down a downwardly inclined exit ramp 144 formed as an extension from the exit end of the frame. More particularly as shown in FIGS. 5 and 13, the gate 42 has an upper section 145 and lower section 147. Each of the sections 145, 147 extends transversely, with its ends extending outwardly to either side of the main portion of the gate. The lower section 147 is pivotally received in a transverse recess 149 in the platform wall surface 38. The opposed ends of the lower section 147 are received in vertically extending slots 151 in the curbs 40 that extend above the surface 38. The opposed ends of the upper section 145 are received in vertically extending recesses 153 in the upper edge of the curbs 40. This construction permits the child-user to grasp the gate 42, raise it upwardly (as permitted by the slots 151 and 153) to remove the ends of section 145 from slots 153, and pivot the gate to the open position shown in broken line in FIG. 5. As shown in FIG. 1, the exit 24 is located generally between the gate 42 of the platform and the exit ramp 144. As shown in FIG. 1, the frame 12 is somewhat enlarged at the spin drying station 18 in an outwardly extending arc at either side of the frame, such arcs having their centers at the vertical axis of rotation of the platform. The top cover 20 is also enlarged outwardly around the platform, also in the form of arcs having their centers at the same vertical axis or rotation of the platform.

As shown in FIG. 5, a drive gear 146 is keyed in the central shaft 142 of the platform for rotation with the platform. The lower end of the platform central shaft 142 extends downwardly through and is journaled in a downwardly extending hub section 148 of a downwardly offset exit end wall portion 150 of the frame upper wall. The platform center shaft 142 includes radial projections 152 at its upper end forming bearing means that contact the wall portion 150 at the upper end of the hub section 148 to maintain the elevation of the platform and serve as the bearing for the spinning platform. The drive gear 146 at the lower end of the center shaft 142 limits upward movement of the platform. As shown generally in FIG. 1, a handle 154 pivotally mounted on the frame extends outwardly from the side of the pan through an elongated horizontal slot 156 and has a gear sector 158 at its other or inner end which engages a planetary gear 160 for engaging and driving the drive gear 146 of the platform. This arrangement is illustrated in further detail in FIGS. 6 and 10. In general, the planetary gear 160 is mounted in slots 162 so that when the handle 154 is moved in one direction the planetary gear 160 will drive the platform, while when the handle is moved in the opposite direction the planetary gear will disengage from the platform drive gear 146 to allow the platform to continue its rotation. In effect, this provides a clutch or one-way drive arrangement so that the handle can be repeatedly cranked back and forth to impart high speed rotation to the platform, while only requiring a limited arc of movement of the handle. More particularly, the handle 154 and gear sector 158 are pivotally mounted for rotation about a vertical shaft 164 supported between the offset rear portion 150 of the frame upper wall and the bottom cover wall 23. Similarly, the planetary gear 160 is mounted on a vertical pin or shaft 166 that extends between those two walls 23, 150. However, each end of this pin 166 is received in one of the short elongated or arcuate slots 162 in one of the walls 23, 150. The slots 162 are positioned and arranged for the operation generally described above. In this connection, as seen best in FIG. 10 counterclockwise movement of the handle 154 will maintain the pin 166 against the lower ends of the slots 162 (as they are shown in that FIG. 10), and will permit rotation to be imparted from the gear sector 158 to the planetary gear 160 and then to the drive gear 146 of the platform. It will be observed that rotation in the opposite or clockwise direction will tend to move the pin 166 and the planetary gear 160 toward the opposite ends of the slots 162 where the planetary gear will be out of engagement with the drive gear of the platform so that the platform is free to continue spinning. It will be noted that substantial mechanical advantage is achieved by the larger gear sector 158 engaging a small gear portion 168 of the planetary gear while a larger gear portion 170 of the planetary gear engages the smaller drive gear 146 of the platform. Thus, a high mechanical advantage and high speed rotation of the platform may be readily achieved by the child-user. Excellent action has been achieved with a gear ratio of 13.5:1. It is believed that ratios of 5:1 to 50:1 could be satisfactorily employed along with platform speeds of 200 to 500 RPM.

As noted above, the bottom cover 21 of the toy encloses the conveyor means (FIG. 3) and forms the bottom and side walls of the reservoir described above, as well as enclosing and protecting the mechanism for the spin drying station.

Various modifications may be made in the illustrated structure without departing from the spirit and scope of the invention as set forth in the appended claims. While the particular illustrated construction offers various advantages in terms of cost and ease of manufacture, assembly and maintenance, as well as providing desirable play value, certain features may be modified or changed as may be desired for particular applications. By way of example, the various operations might be motorized rather than being manually powered, the particular conveyor belt configuration could be modified, an overhead reservoir might be utilized to obviate the need for a pump mechanism for the wetting station, and the brushes for the brushing station could be differently arranged or positioned. With regard to the spin drying station, while the illustrated structure offers various distinct advantages as outlined above, to reduce costs or to provide a simplier version of the toy for younger children, the platform might be rotated by a simple yoke and hand crank as illustrated schematically in FIG. 12. Along similar lines, the means for holding the car may be varied and if desired positive holding or clamping means might be provided with the spin drying station being openable to permit the child-user to clamp or secure the car in place before the spinning is undertaken. Alternately, holding or clamping means might be mechanically operated without the necessity for access to the spin drying station. Various other mechanical arrangements for imparting rotation to the platform may also be utilized. Also while it is desirable to enclose the full car wash line as presented in the illustrated toy, the cover or enclosure might be eliminated except for the spin drying station. Further, the car wash line need not be linear but might progress along a circular or other path.

What is claimed is:

1. A toy car wash comprising:

(a) means defining an elongated frame having an entrance end and an exit end, and an upper wall;

(b) means on said frame defining a transparent cover at least partially enclosing an elongated car wash area above said upper wall, and forming, with said frame means, an entrance at said entrance end and an exit at said exit end; and (c) means mounted on said frame within said car wash area for advancing a toy vehicle along said car wash area, for applying water to the vehicle, and for spinning the wet vehicle to remove water therefrom.

2. The toy car wash of claim 1 further comprising separate manually operate means for advancing the toy vehicle, for applying water to the vehicle, and for spinning the wet vehicle.

3. The toy car wash of claim 2 wherein each of said manually operable means may be operated at a rate and, within outer limits, for a duration determined by the user.

4. The toy car wash of claim 1 wherein said means for spinning the vehicle includes a rotatable platform for receiving and retaining the vehicle during spinning movement.

5. The toy car wash of claim 4 wherein said means for spinning the vehicle further includes a manually movable lever for imparting energy to effect rotation of the platform.

6. The toy car wash of claim 5 wherein said means for spinning the vehicle further includes means between the movable lever and the rotatable platform for multiplying movement of the lever to increase the speed of rotation of the platform for given lever movement by at least 5:1.

7. The toy car wash of claim 4 wherein said means for advancing the vehicle comprises a manually actuatable conveyor.

8. The toy car wash of claim 7 wherein said rotatable platform includes means defining a car-receiving receptacle having an inclined bottom support surface, and an openable gate means at the lower end of said incline surface, said platform being positionable to align the upper end of said incline surface with said conveyor.

9. The toy car wash of claim 8 wherein the discharge end of the conveyor is higher than the upper end of said inclined surface, and said frame has an inclined section positioned intermediate the discharge end of the conveyor and the platform.

10. The toy car wash of claim 8 wherein said frame supports said conveyor and said platform at a position above the surface which supports the frame, and said frame includes an upwardly inclined entrance ramp leading up to the entrance end of the conveyor and a downwardly inclined exit ramp at the exit adjacent the platform.

11. The toy car wash of claim 7 wherein said means for applying water includes a reservoir located below said upper wall and means defining discharge openings in communication with the reservoir and positioned sufficiently above the conveyor to permit the toy car on the conveyor to pass below the openings.

12. The toy car wash of claim 1 further including means on said frame within said car wash area for applying brushes to the toy vehicle as it is advanced along said car wash area.

13. A toy car wash comprising:

(a) frame means providing an elongated car wash line having an entrance end and an exit end;

(b) wetting means on said frame means for applying water to a toy vehicle on said car wash line;

(c) spin drying means on said frame means at a spin drying station located down-line of said wetting means for retaining and spinning the wet toy vehicle to remove water therefrom; and (d) transparent cover means on said frame means at least partially enclosing the spin drying station to retain water propelled from the wet toy vehicle as it is being spun.

14. The toy car wash of claim 13 further comprising separate manually operable means for actuating said wetting means and for actuating said spinning means.

15. The toy car wash of claim 14 wherein each of said manually operable means may be operated at a rate and, within outer limits, for a duration determined by the user.

16. The toy car wash of claim 13 wherein said means for spinning the vehicle includes a rotatable platform for receiving and retaining the vehicle during spinning movement.

17. The toy car wash of claim 16 wherein said means for spinning the vehicle further includes a manually movable lever for imparting energy to effect rotation of the platform.

18. The toy car wash of claim 17 wherein said means for spinning the vehicle further includes means between the movable lever and the rotatable platform for multiplying movement of the lever to increase the speed of rotation of the platform for given lever movement by at least 5:1.

19. The toy car wash of claim 18 wherein said lever is pivoted for reciprocating motion and is coupledd by a one-way clutch mechanism to the rotatable platform so that reciprocating movement of the lever is translated into one-way rotation of the platform.

20. The toy car wash of claim 16 wherein said rotatable platform includes means defining a car-receiving receptacle having an in inclined bottom support surface.

21. The toy car wash of claim 13 wherein said means for applying water to the vehicle comprises a reservoir for holding a supply of water and means including a discharge opening for delivering water from the reservoir onto the toy vehicle.

22. The toy car wash of claim 21 wherein said discharge opening is positioned above the toy vehicle.

23. The toy car wash of claim 22 wherein said reservoir is located below said frame upper wall and said water applying means further comprises hand operable pumping means for effecting movement of water from the reservoir through the elevated discharge opening.

24. The toy car wash of claim 23 wherein said pumping means is hand powered.

25. The toy car wash of claim 13 further comprising elongated conveyor means extending along said upper wall for supporting and advancing the toy vehicle from the entrance and toward the exit end and at least to and past said water applying means to said spin drying station.

26. The toy car wash of claim 8 wherein said receptacle defining means and said gate means are proportioned and arranged to retain the vehicle without further securement during rotation of the platform at speeds of about 200 RPM or more.

27. The toy car wash of claim 6 wherein the multiplier of movement between the lever and the platform is in excess of 10:1.

28. A manually-powered, multistation, enclosed toy car wash for a toy vehicle, comprising:

(a) an elongated housing having a top wall and an entrance and exit end; said housing defining a car wash line above said top wall and extending forwardly between said ends;

(b) an elongated transparent top cover mounted on said housing and substantially enclosing said car wash line;

(c) advancing means on the housing and extending along said car wash line for supporting the toy vehicle and causing it to move forwardly;

(d) manually operable means for actuating the advancing means;

(e) means on the housing defining a wetting station along said advancing means, comprising:

(1) means in said housing defining a reservoir for water;

(2) means on the housing defining at least one water outlet above said advancing means;

(3) manually operable pump means operatively connected to said reservoir means and said outlet means to pump water from the reservoir to the outlet, for discharging water onto the toy vehicle;

(f) means on the housing defining a spin-drying station located forwardly of the wetting station, comprising:

(1) a support platform for supporting the toy vehicle, the platform being rotatably mounted on the housing;

(2) retainer means on the platform for receiving and retaining the toy vehicle in place on the platform during rotation of the platform, comprising:

(a) spaced-apart side retainer curb means, (b) operable retainer exit gate means, and (c) a support surface between the curb means and inclined downwardly toward the gate means;

(3) manually operable drive means on the housing for imparting rapid rotation to said platform, comprising:

(a) manually operable handle pivotally mounted on the housing for reciprocating movement; and (b) means defining a gear train between the handle and the platform to multiply the movement of the handle.

29. The toy car wash of claim 28 further comprising means on said housing defining a brushing station along said advanced means forwardly of said wetting station, comprising:

(1) a pair of side brushes supported on the housing top wall at opposite sides of said advancing means, positioned so as to engage the toy vehicle as it is advanced through said brushing station;

(2) a center brush movably mounted on the housing for engagement with the toy vehicle as it is advanced through said brushing station.

30. A method of washing a toy car with water with a minimum of risk of water damage to the surroundings, comprising the steps of:

(1) providing a housing which essentially encloses an elongated toy car wash line and includes a transparent cover for viewing activity under the cover and along the line, there being an entrance and an exit at opposite ends of the line for a toy car;

(2) introducing the toy car into the entrance;

(3) causing, from outside of the housing, the car to advance along the line;

(4) causing, from outside the housing, water to be applied to the toy car, at a first location along the line;

(5) causing, from outside the housing, the car to advance to a second location along the line;

(6) causing, from the outside the housing, the car to spin rapidly at said second location to remove water from the wet car; and (7) causing the car to pass outwardly through the exit.

31. The method of clam 30 wherein at least each of steps (3)–(6) are achieved by separate manual actuation of a mechanism at individual user-selected rates and, within limits of the device, for user-selected durations.

* * * * *